United States Patent [19]

Leach

[11] Patent Number: 4,813,495

[45] Date of Patent: Mar. 21, 1989

[54] METHOD AND APPARATUS FOR DEEPWATER DRILLING

[75] Inventor: Colin P. Leach, Houston, Tex.

[73] Assignee: Conoco Inc., Ponca City, Okla.

[21] Appl. No.: 46,823

[22] Filed: May 5, 1987

[51] Int. Cl.[4] ..... E21B 7/124; E21B 7/128

[52] U.S. Cl. ..... 175/6; 166/358; 175/7

[58] Field of Search ..... 175/5, 6, 7, 9; 266/358, 68, 105, 335

[56] References Cited

U.S. PATENT DOCUMENTS

| | | | |
|---|---|---|---|
| 3,209,829 | 10/1965 | Haeber | 166/66.5 |
| 3,259,198 | 7/1966 | Montgomery et al. | 175/7 |
| 3,372,761 | 1/1968 | Van Gils | 175/25 |
| 3,587,734 | 6/1971 | Shaffer | 175/7 |
| 3,603,409 | 9/1971 | Watkins | 175/25 |
| 3,638,721 | 2/1972 | Harrison | 175/7 X |
| 4,046,191 | 9/1977 | Neath | 175/25 |
| 4,063,602 | 12/1977 | Howell et al. | 175/7 |
| 4,149,603 | 4/1979 | Arnold | 175/217 |
| 4,291,772 | 9/1981 | Beynet | 175/25 |
| 4,527,632 | 7/1985 | Chandot | 166/357 |
| 4,531,593 | 7/1985 | Elliot et al. | 166/105 X |
| 4,595,343 | 6/1986 | Thompson et al. | 175/217 |
| 4,611,661 | 9/1986 | Hed et al. | 166/339 |

FOREIGN PATENT DOCUMENTS

| | | | |
|---|---|---|---|
| 905412 | 2/1982 | U.S.S.R. | 175/5 |

*Primary Examiner*—Hoang C. Dang

*Attorney, Agent, or Firm*—Richard K. Thomson

[57] ABSTRACT

A method and apparatus for drilling subsea wells in water depths exceeding 3000 feet (preferably exceeding 4000 feet). Drilling mud returns are taken at the seafloor and pumped to the surface by a centrifugal pump that is powered by a seawater driven turbine. A low-differential pressure rotating head seats in the upper tapered portion of the longitudinal throughbore of an upper stack package which is attached to the top of the blowout preventer stack and seals against the drill string as it is run in and out of the borehole. The method and apparatus of the present invention enable higher mud weights to be used than can be used in conventional techniques which allows kicks to be more easily controlled, fewer casing strings to be run, and overall drilling time reduced by up to 40%.

16 Claims, 4 Drawing Sheets

METHOD AND APPARATUS FOR DEEPWATER DRILLING

BACKGROUND AND SUMMARY OF THE INVENTION

The present invention relates to a method and apparatus for economically drilling oil and gas wells in deep water (i.e., exceeding 3000 feet, more preferably exceeding 4000 feet). More particularly, the present invention relates to a method and apparatus for drilling wells in deepwater without a conventional riser including taking the drilling mud returns at the mudline and pumping the to the surface.

As the frontiers of energy exploration are pushed into deeper and deeper waters, developers are being forced to investigate more economic drilling techniques in order to offset the cost increases associated with drilling in those deeper waters. In addition, conventional drilling techniques are limited, in certain circumstances, by formation and fracture pressure gradients. These circumstances include: (1) formations that are abnormally pressured, i.e., the pore pressure gradient (the pressure of the well fluids in the formation pores) exceeds the pressure gradient produced by a column of seawater in the drill string; (2) formations in water depths exceeding 3000 feet (915 m); and, (3) formations in which directional (highly angulated) wells are drilled, since extra pressure must be exerted by the drilling fluid to maintain stability of the deviated wellbore.

The method and apparatus of the present invention overcomes the problems of conventional drilling techniques by moving the base line for measuring pressure gradients from the surface of the ocean to the mudline. This is done by taking the drilling mud returns at the ocean floor and pumping them to the surface rather than requiring the returns to be forced upwardly through a riser by the downward pressure of the mud column, as is the case in conventional drilling techniques. A seawater-powered centrifugal pump is preferred to pump the returns through a mud return line to the surface. A lift pump near the surface pumps seawater onto the platform where a powerfluid pump pumps the seawater down a powerfluid conduit to the turbine that drives the centrifugal pump.

A rotating head is detachably secured to a running collar that is fixedly attached to the drill string at a particular position that is most preferably just above the drill bit and mud motor. An upper stack package that may be a separate apparatus that is attached to the top of a conventional blowout preventer stack or, may itself form the uppermost component of a specially configured blowout preventer stack, receives the rotating head as the drill string is run in. The rotating head has a plurality of spring biased dogs which seat in indentations in the upper stack package and the shear pins that were detachably securing the rotating head to the running collar are broken to permit the string to continue being run in. A cartridge of the rotating head contains a stripper rubber (or gasket) which engages and seals around the drill string as it is run in and out. At least one annular protrusion on the running collar engages actuators for spring actuator dogs on the lower surface of the rotating head to dislodge the rotating head from the upper stack package as the drill string is being tripped out, e.g., for a bit change, or the like. This permits easy changeover of the cartridge of the rotating head, the most wear prone component of the assembly, to insure adequate sealing between the rotating head and the drill string which isolates the seawater above the rotating head from the drilling mud therebelow.

Various other features, characteristics and advantages of the present invention will become apparent after reading the following detailed description.

BRIEF DESCRIPTION OF THE FIGURES

FIG. 2 is a detailed close-up of the rotating head detachably secured to the running collar as it is being run in;

DETAILED DESCRIPTION OF THE PREFERRED EMBODIMENT(S)

Figure 1:
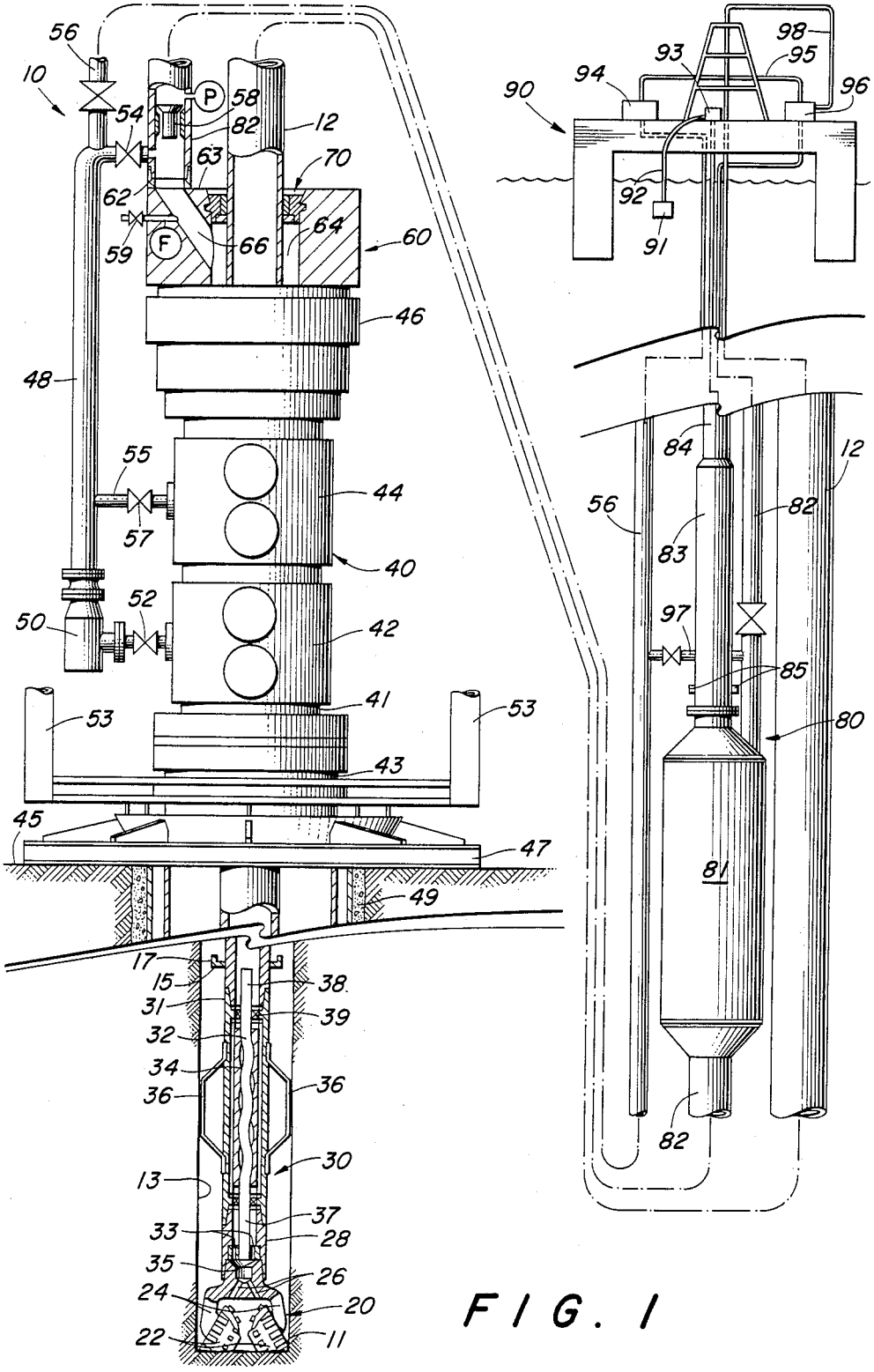
FIG. 1 is a schematic side view (not to scale) of the drilling system of the present invention.

The drilling apparatus of the present invention is depicted in FIG. 1 generally at 10. The drilling apparatus 10 is comprised of drill bit 20, mud motor 30, blowout preventer stack 40, upper stack package 60, mud return system 80, and drilling platform 90.

Drill bit 20 is of conventional design having each of three (two shown) rotating toothed cutting elements 22 secured to an arm 24. Jet ports 26 direct streams of drilling mud to the interface between cutting elements 22 and bottom 11 of borehole 13 to facilitate drilling. Although drill bit 20 could be rotated by rotating drill string 12 in a conventional manner, it is preferred that section 28, to which mounting arms 24 are affixed, be rotated by mud motor 30. This enables the rate of rotation of the drill string 12 to be appreciably reduced (e.g., from 100 to 20 rpm) which greatly reduces the frictional wear on sealing components as will be discussed in greater detail hereafter.

Mud motor 30 is depicted as a Moyno pump including a rotor 32 and elastomeric stator 34. Alternatively, mud motor 30 could be of a turbine type. Centralizers 36 center the motor 30 and attached drill bit 20 in borehole 13. The upper end 38 of rotor 32 is free, being held in position by bearing element 39. Lower end 37 of rotor 32 is keyed to lower bearing 35 that is nonrotatably attached to lower rotating section 28. Throughbores 33 permit the drilling fluid to pass through lower bearing 35 and exit through jet ports 26. Pressurized drilling mud pumped down drill string 12 will drive rotor 32, rotating drill bit 20 and, hence cutting elements 22. The configuration of elements 22 affords the cutting action as bit 20 is rotated.

Blowout preventer stack 40 is of conventional design. By way of example, stack 40 is shown as having first

(42) and second (44) pairs of ram preventers and an annular preventer 46. Actually, each member of pairs 42 and 44 shown in FIG. 1 is itself a pair since there are corresponding opposing rams on the opposite side of the stack (not shown). Of course, stack 40 may have a greater number of preventers, if desired. Stack 40 s hung on a 20" casing 41 in a conventional manner, said 20" casing protruding upwardly from the 30" casing 43 to afford access. The 30" casing is cemented in the ground 45 below template 47 as at 49. The blowout preventer stack includes a choke/kill line 48 with an adjustable choke 50. The choke/kill line provides an alternative path for the mud returns and well fluids when valves 52 and 54 are opened and one or more of ram pairs 42,44 or annular preventer 46 have been closed in response to a kick, or the like. By adjusting the size opening of the choke 50, back pressure can be put on the well to control the kick to prevent a blowout. Once controlled, the kick can be cycled out of the wellbore to enable the well fluids to be analyzed and then, heavier mud can be pumped into the well, as necessary, either through drill string 12 or, alternatively, through high pressure kill line 56 to avoid a reoccurrence of the kick. An optional second line 55 with valve 57 may be connected to the blowout preventer stack at, for example, the second pair of rams 44 to permit fluids to be pumped into the wellbore through kill line 56 without going through choke 50. Choke/kill line 48 dumps back into mud return line 82 just upstream of oneway check valve 58. Relief valve 59 permits the mud returns to be dumped to the seabed in the event of an emergency. (Although this would be both an expensive and environmentally undesirable solution, there could arise a situation where safety considerations would make it the only viable alternative.

Upper stack package 60 may be a separate unit that is secured to the top of a conventional blowout preventer stack 40 or, alternatively, may be the uppermost element of a specially configured blowout preventer stack. The former configuration is preferred because of system flexibility. In such a case, upper stack package 60 will be equipped with conical guides (not shown) to engage over guide pins 53. Guide pins 53 will, of course, project above the top of upper stack package 60 but have been broken off in FIG. 1 so as not to further complicate the Figure.

The two most important features of the upper stack package 60 are the connecting point 62 for the mud return line 82 and the rotating head 70. Upper stack package 60 has a longitudinal central opening 64 that forms a continuation of the longitudinal aperture in blowout preventer stack 40. A second opening 66 branches off the main opening 64 and intersects the upper surface 63 of upper stack package 60 defining the location of connecting point 62 to which mud return line 82 is attached. A two-way flow sensor F is preferably provided as part of a kick detection/control circuit.

Figure 2:
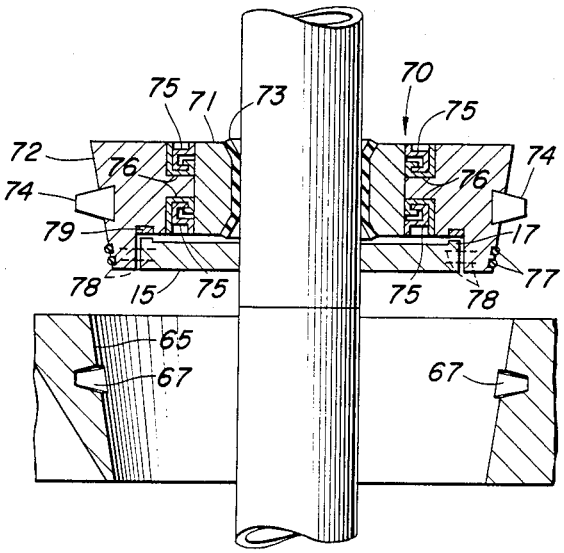

Rotating head 70 is, preferably, a low-differential pressure member which is seated in a tapered upper portion 65 of main opening 64. As seen in greater detail in FIG. 2, rotating head has an inner cartridge portion 71 and an outer bushing portion 72. The shape of the exterior of bushing 72 is tapered to seat tightly in tapered opening 65. Cartridge 71 includes stripper rubber 73 that seals against drill string 12 while permitting it to slide axially therethrough. spring biased dogs 74 (preferably four or more) are located on bushing 72 and lock into place in recesses 67. Alternatively, a plurality of split ring dogs could be received in a continuous annular slot in the upper stack package. Two of complementarily configured labyrinthian sealing elements 76 on bearing 72.

Bearing 72 locks in place in tapered opening 65 and O-ring seals 77 prevent the influx of seawater into the upper stack package 60 between the rotating head 70 and said upper stack package. Cartridge 71 with stripping rubber 73 fits tightly against drill string 12 and rotates therewith, although there may be some rotational slippage between the cartridge 71 and drill string 12. The labyrinthian seals 75 and 76 are but exemplary of the means that may be provided to permit cartridge 71 to rotate relative to bearing 72 while preventing influx of seawater. The seals 75 and 76 may be constructed either of steel or, more preferably, of a fiber-reinforced plastic, such as a polyurethane or epoxy matrix reinforced with carbon fibers, for example.

Rotating head 70 is run in on drill string 12 by running collar 15 that is fixedly attached to drill string 12 as by tack welding, or the like. Running collar 15 will be dimensioned so that it may fit through the smallest casing diameter that has thus far been run. Rotating head 70 is detachably connected to running collar 15 by shear pins 78. As the drill bit 20 is run in through upper stack package 60 and blowout preventer stack 40, drill string 12 is being rotated at a rate of about 20 rpm. When rotating head 70 seats in tapered opening 65, dogs 74 engage in recesses 67. Continued drill string rotation (or axial penetration, with or without rotation) snaps shear pins 78 enabling collar 15 and drill string 12 to continue running in. Running collar 15 has an annular protrusion 17 that is formed on its upper surface near its periphery. As the drill string is being withdrawn from the borehole 13, annular protrusion 17 engages a ring actuator 79 formed on the lower inner face of bearing 72. Engagement of actuator 79 by protrusion 17 causes dogs 74 to be retracted so that rotating head 70 can be withdrawn with the drill string 12. While running collar 15 can be secured anywhere on drill string 12, it is preferred that the collar be attached to string 12 immediately above the upper end 31 of mud motor 30. It is preferred that mud be pumped into wellbore 13 as the drill string 12 is withdrawn, either through mud return line 82 or down drill string 12 and drill bit 20, or both, to fill up the volume formerly occupied by the drill string 12. Pumping mud into borehole 13 in conjunction with the placement of the running collar 15 immediately behind mud motor 30, minimizes the amount of seawater entering the upper stack package 60 after the rotating head 70 is removed.

The mud return system 80 comprises a mud return pump 81 positioned in mud return line 82 adjacent the upper stack package 60. A pressure sensor P is positioned upstream of mud return pump 81 and is also part of the kick detection/control circuit. Pump 81 is preferably a centrifugal pump powered by a seawater powered turbine 83. A power fluid line 84 transmits the seawater from the drilling platform 90 to the turbine 83. Spent powerfluid is discharged back to the ocean through discharge ports 85, thereby avoiding the use of any additional energy to pump it back to the surface, or the like. A seawater lift pump 91 is submerged in the ocean to lift seawater onto platform 90 via line 92 feeding it to powerfluid pump 93. The pump 93 is directly connected to powerfluid line 84 to pump pressurized seawater down said line to operate mud return pump 81 by rotating turbine 83. High pressure line 56 is connected to another pump 94 and may be connected through a branch line 95 to a mud processing unit 96, depending on the direction fluid is flowing in line 56.

Figure 3:
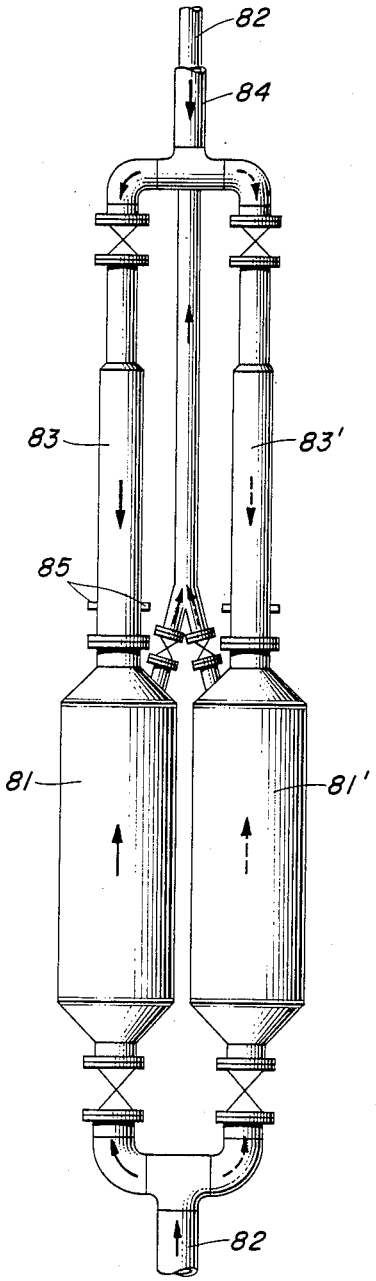
FIG. 3 is exemplary of one possible arrangement to permit redundance of the mud pump, a critical element of the system.

As depicted in FIG. 3, a back up pump 81' and turbine 83' are preferably provided through branch lines in mud return line 82 and powerfluid line 84 and brought into operation by suitable valving, to provide redundancy in this key system component. A branch line 97 (FIG. 1) interconnects mud return line 82 with pressure kill line 45 also through suitable valving. In the event of a rupture or blockage in mud return line 82, mud returns may be pumped through branch line 97 and up return line 56 to the surface.

Figure 4:
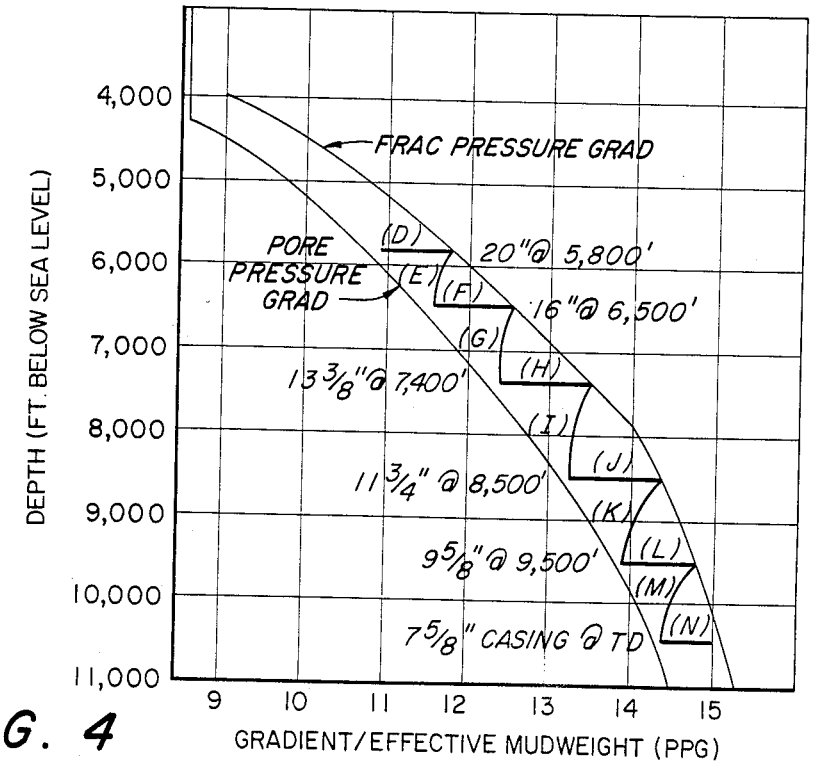
FIG. 4 PRIOR ART
FIG. 4 is a conventional casing design for a 4000 foot water depth as pore pressure an fracture pressure require.
Figure 6:
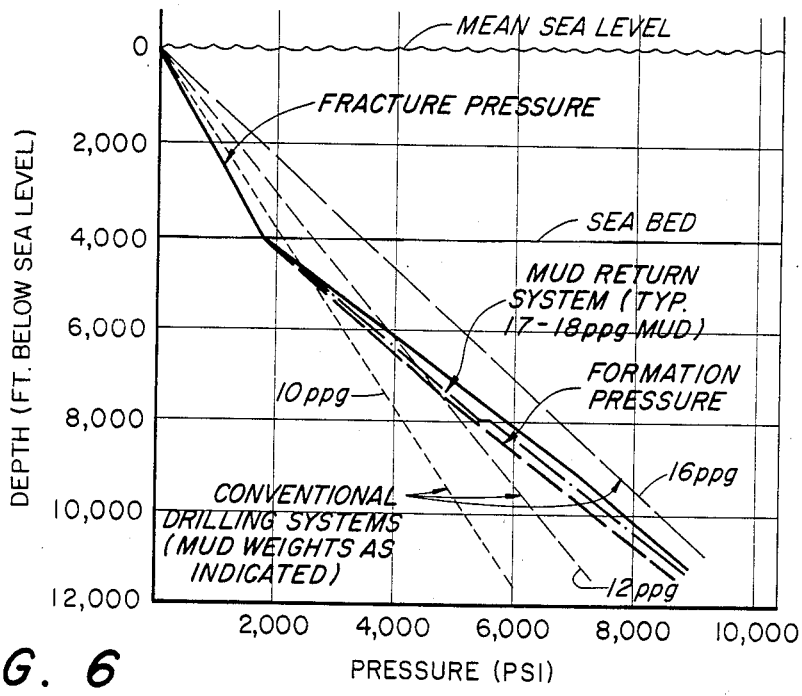
FIG. 6 is a plot of absolute pressure data versus depth for both conventional drilling and for the mud return system of the present invention.

Before explaining in detail the operation of the method and apparatus of the present invention, reference should be had to FIGS. 4 and 6 for a better understanding of conventional techniques. As depicted in FIG. 4, a conventional casing design in 4000 foot water depth would require on the order of seven strings of casing to reach the 6500 feet drilled depth. Conventionally, a 36" hole is drilled and a 30" casing run and grouted to a depth of about 300 feet below the seabed. Alternatively, where the soil lacks sufficient integrity to retain its shape after drilling, the 30" casing will be jetted into the seabed using a high pressure water stream.

Next, a 26" hole will be drilled to a depth of 1500 to 2000 feet (1800 feet in FIG. 4) below the seafloor. A 20" casing is hung off on the 30" casing and the 20" casing cemented in place with the cement column extending upwardly into the lower end of the 30" casing. Then the blowout preventer stack is run on the drill string and secured to the protruding top of the 20" string. Next a 17.5" hole is drilled (the I.D. of a 20" casing is 18.75") to a depth of about 2500 feet below the seafloor and then underreamed to 22" to provide adequate clearance for proper cementing of the 16" casing in place.

At this point, it should be noted that the large number of casing strings required is a result of the narrow operating range provided by the closeness of the fracture pressure gradient to the pore pressure gradient (FIG. 4). It is necessary when drilling in overpressured regions, to use a mud weight that exceeds the pore pressure in order to reduce the risk of a kick. At the same time, the mud weight cannot produce a pressure gradient that exceeds the fracture pressure gradient for a particular depth or the formation will be damaged, permitting the well fluids to seep out.

This problem (the large number of strings) is due in large part to the slope difference between the pressure curves for the various mud weights (increasing linearly from zero beginning at the surface) and the formation and fracture pressure curves (which increase from a minimum value at the seafloor at a greater rate than the mud weight pressure curves). As can be seen in FIG. 6, for any particular mud weight, the pressure curve intersects the fracture pressure line first and then the pore pressure line. The difficulty arises due to the fact that the mud weight must produce a pressure that is less than the fracture pressure gradient, but greater than the pore pressure, as discussed above. If the slopes were such that the pressure lines for the various mud weights were much more nearly parallel to the pore pressure and fracture pressure lines, a single mud weight could be used for a much longer interval.

Returning now to the description of the conventional casing design for 4000 foot water depth, once the 16" casing has been cemented to 2500 feet below the seafloor, a 14.75" hole is drilled (the 16" casing has an I.D. of 15") and underreamed to 17.5" to a depth of 3400'. Then, 13.375" casing is run and grouted in place, the cement column, as in instance of each string, extending upwardly into the lower end of the previously hung casing.

The next step is to drill a 12.25" hole to 4400 feet below the seafloor and underream it to 14.75", setting and cementing the 11¾" casing. Then a 9.875" hole is drilled, underreaming to a diameter of 12.25", and the 9.625" casing run to a depth of 5500 feet below the seabed. Finally, a 8.5" hole is drilled to total depth, in this case, 6500 feet below the mudline, and the 7.625" casing is set and cemented in place.

Looking again at FIG. 6, the benefits of the present invention afforded casing design become apparent. The 10 pound per gallon mud weight pressure curve, the 12 pound curve and the 16 pound curve are all linear, the pressures all increasing linearly with column height for a given diameter. Progressing from the 10 ppg curve to the 12 ppg curve to the 16 ppg curve, it becomes apparent that the slopes of the pressure curves decrease with increasing mud weight (i.e., heavier mud weights increase pressure more rapidly for a particular depth), and that a 17 to 18 pound per gallon mud weight would produce a pressure curve with a slope that was substantially parallel to the pore pressure and fracture pressure curves. However, it is also apparent that for conventional techniques (starting point at sea level), a 17–18 pound mud weight would exceed the fracture pressure limits of the formation for all depths by a significant amount.

Figure 7:
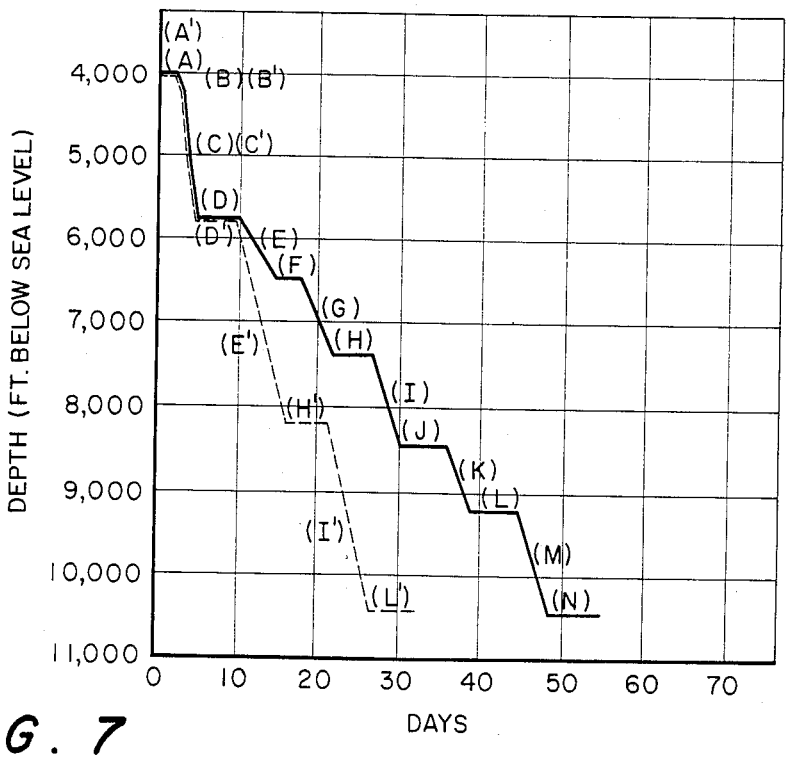
FIG. 7 is a comparative plot of overall time required to drill 6500 feet below the seabed using the conventional casing design shown in FIG. 4 versus the apparatus using the mud return system design shown in FIG. 5.

Taking the mud returns at the seafloor removes the pressure of the mud in the riser from the formation. This has the effect of shifting the pressure curves for the heavier 17–18 ppg mud weights (indeed, all mud weights), to the left. Further, by taking the returns at the mudline (seafloor), the pore pressure curve, fracture pressure curve and mud pressure curve are given the same starting point defined by the hydrostatic pressure of the water column above the seabed (i.e., the pressure has a fixed value for the particular water depth). The initial steps of the drilling operation (as indicated in FIG. 7) for a mud return system and a conventional system are identical. Steps A and A' (the primes indicating the steps of the mud return system) involve surface preparation, template installation, and the like. Steps B and B', the jetting the 30" casing to a depth of 300' below the seabed. Steps C and C' drilling a 26" hole to a depth of 1800 feet below the seafloor. This is done using a riserless drilling technique in each system. Steps D and D' include setting the 20" casing and cementing it in place and hanging off the blowout preventer (BOP) stack on the 20" casing. Also included in step D is the running of a riser from the BOP stack to the drilling platform whereas step D' runs a mud return line and pump system in substantially the same time frame.

It is at this point that the mud return system significantly deviates from the conventional system and the time savings begin to appear. With a mud weight of 17 ppg, a single diameter bore of 16" (rather than the 17½" hole for conventional drilling) can be run for 13⅜" casing to a depth of 4250 feet below the seabed. A 16" hole produces fewer cuttings and results in a cleaner (more uniform) hole. Note, for the conventional system to reach this depth, three separate bores with three different mud weights have to be drilled, complete with underreaming and logging of the borehole. The mud return system makes underreaming unnecessary, reduces the number of casing strings that must be run, and reduces the amount of time expended in logging runs (it is less time consuming to make fewer, longer runs).

Generally, only one additional drilling run will be necessary to reach total depth (in the example, 6500 feet below the seabed). A 12½" hole can be drilled to depth using an 18 ppg mud and a 9⅝" casing set and cemented in place.

Figure 5:
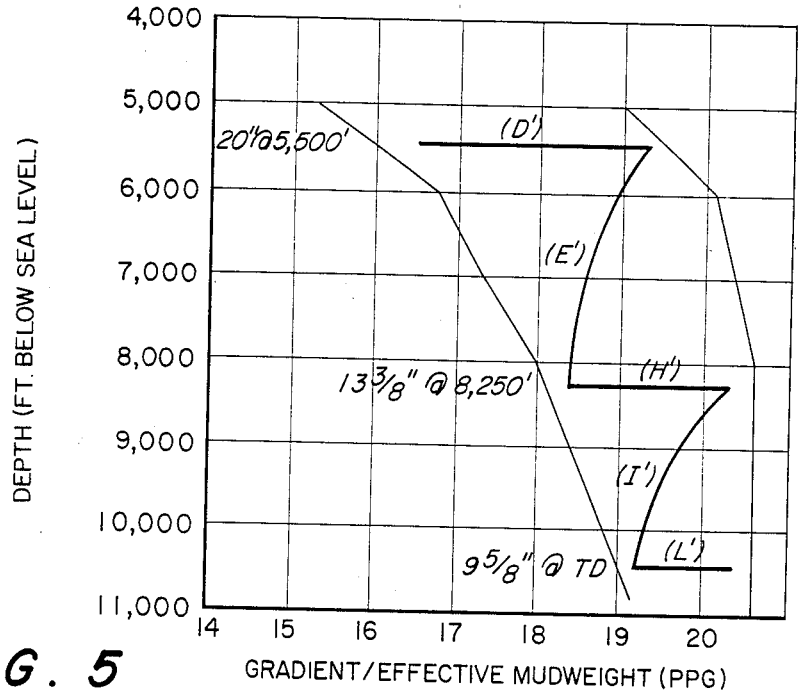
FIG. 5 is a casing design for a 4000 foot water depth employing the mud return system of the present invention.

As shown in FIG. 7, the simplified casing design made possible by the mud return system (compare FIG. 4 and 5), enable a 40% reduction in time needed to complete the well, reducing from 55 days to 33 days the time required. This 40% reduction in time translates loosely into a corresponding 40% reduction in the cost of drilling the well. Further savings can be afforded by the mud return system: since the drilling platform need not provide deck storage space for 4000 feet of 21" riser, a smaller drilling rig, usually confined to use in shallower waters, can be used. These rigs are less expensive to operate. The drilling platform 90 of the present invention may take the form of a semi-submersible, a tension leg platform, a buoy-moored vessel, or any other rig design desired.

Portions of the installation and operation of the method and apparatus of the present invention will be apparent from the foregoing description. The installation of the 30" casing, the 20" casing and the BOP stack is identical to that of the conventional drilling system. At this point, however, instead of running a riser through which the drill string is run and the spent mud with cuttings returns to the platform, a separate mud return line 82 is connected to the upper stack package 60 (which may be run with the BOP or may be run in one the mud return line 82). The mud return pump 81 and associated turbine 83 make up a portion of mud return line 82 and are set in position as that line is run.

Drill string 12 is run through the upper stack package 60 and BOP stack 40. At a point on the drill string 12 just behind the downhole mud motor 30 (preferably as part of sub-assembly 14), running collar 15, detachably mounting rotating head 70, is run into the upper stack package 60. As the rotating head 70 approaches upper stack package 60, drill string 12 is rotated at 20 rpm. When the rotating head 70 engages in the tapered portion 65 of opening 64, dogs 74 seat in recesses 67. Further, rotation or translation of drill string 12 breaks shear pins 78, leaving the rotating head behind as the running collar 15 continues to run in with the drill bit 20. O-ring seals prevent influx of seawater between the upper stack package 60 and rotating head 70. Stripper rubber 73 seats tightly against the longitudinally sliding drill string and labyrinthian seals 75 and 76 prevent leakage between stationary bushing 72 and rotating cartridge 71.

As drilling is initiated, drilling mud is pumped down through the drill string 12 through line 98 by a pump which forms a portion of mud processing unit 96, operates mud motor 30, and is forced through jet orifices 26 to facilitate the job of cutting elements 22. The expended mud ladened with cuttings is forced up the borehole into BOP tack 40 and upper stack package 60 into mud return line 82. When pressure sensor P senses a pressure increase suggestive of mud being present, lift pump 91 and powerfluid pump 93 are actuated to impel seawater down line 84 to activate turbine 83 and, in turn, mud return pump 81. Mud returns are pumped up line 82 to platform 90 where they are processed by a conventional mud processing unit 96 and the mud is recycled downhole. Should there be a blockage in mud return line 82, flow may be deviated through branch line 97 to high pressure kill line 56 and the pumped via branch line 95 to processing unit 96.

When the drill string needs to be tripped, for a bit change or because the drilling leg has been completed, mud will be pumped into borehole 13, either through drill string 12, high pressure choke/kill line 56, or both, at a rate sufficient to fill the volume formerly occupied by the drill string 12 as the string 12 is withdrawn. As the running collar 15 approaches the rotating head, annular protrusion 17 contacts actuator ring 79 retracting locking dogs 74 enabling the rotating head to be tripped out of the hole with the bit 20. If another drilling run is necessary, a second sub-assembly 14 will be available to enable rapid changeover.

If a pressure rise indicative of a kick is detected by pressure sensor P, one more of the blowout preventers will be actuated and the flow diverted through the choke/kill line 48. Adjustable choke 50 will have been preadjusted to exert a back pressure on the formation being drilled (i.e., for the depth below the last casing set) that is slightly less than the fracture pressure for that depth. This is the maximum permissible pressure and, hopefully, will provide a sufficient pressure drop across the orifice 50 to enable the kick to be controlled. Once controlled, the kick will be cycled to the surface to analyze the well fluids producing it, so a heavier mud of appropriate weight can be used to prevent any reoccurrence of kicks. It will be appreciated that the use of 17–18 ppg mud will greatly reduce the likelihood that a kick will occur in the first place.

Various other changes, alternatives and modifications will become apparent to persons of ordinary skill in the art following a reading of the foregoing specification. Accordingly, it is intended that all such changes, alternatives and modifications as come within the scope of the appended claims, be considered part of the present invention.

We claim:

1. Apparatus for drilling an offshore well in water depths exceeding 3000 feet, and similar wells where a pressure gradient from a drilling fluid is likely to be abnormally high, said drilling being accomplished through a previously installed subsea wellhead from an above-surface platform without the use of a conventional riser, said apparatus comprising:

(a) a blowout preventer stack attached to said subsea wellhead;

(b) an upper stack package affixed to the upper portion of said blowout preventer stack;

(c) a drill string extending through said wellhead, said blowout preventer stack and said upper stack package, said drill strings conveying drilling mud from said platform to a drill bit;

(d) a rotating head assembly detachably secured in said upper stack package to isolate the seawater above said rotating head from said drilling mud therebelow, said rotating head slidably receiving said drilling string;

(e) a running collar fixedly attached to said drill string at a particular location above said drill bit said collar being initially attached to said rotating head assembly by shear pins for running into said upper stack package;

(f) a mud return line extending from said upper stack package to said platform to convey said drilling mud and resulting cuttings from said drill bit to said platform; and (g) pump means positioned in said mud return line near said upper stack package to pump said mud returns to said above-surface platform, said pump means being powered by a hydraulic fluid; whereby the pumping of the mud returns to the above-surface platform serves to reduce said abnormally high pressure gradient by an amount equal to a differential gradient between that which is caused by a surface-to-seabed column of drilling mud and that which is caused by a column of seawater of equivalent length.

2. The apparatus of claim 1 wherein said upper stack package further comprises seal means in said rotating head slidably engaging said drill string to insure isolation of said seawater from said mud returns.

3. The apparatus of claim 1 further comprising a powerfluid conduit interconnected between said platform and said pump means for conveying powerfluid to said pump means.

4. The apparatus of claim 3 wherein said pump means comprises a sea-water-powered centrifugal pump and said hydraulic fluid comprises seawater.

5. The apparatus of claim 4 further comprising a lift pump, to pump seawater from the ocean onto said drilling platform and a powerfluid pump, to pump said seawater down said powerfluid conduit to said pump means.

6. The apparatus of claim 5 wherein said pump means further comprises a turbine for powering said pump, said turbine having impeller blades which are driven by said seawater that is pumped down said powerfluid conduit.

7. The apparatus of claim 6 wherein said spent powerfluid is discharged to said ocean from said turbine.

8. The apparatus of claim 1 wherein said pump means comprises redundant fluid power pumps, each of which is alternatively connectable to both a powerfluid conduit and to a mud return line which extends from said upper stack package on the one hand, and to the above-surface platform on the other hand.

9. The apparatus of claim 1 further comprising at least one choke/kill line providing an alternative flow path to that offered by said blowout preventer stack, said choke/kill line containing an adjustable choke orifice.

10. A method of drilling an offshore well in water depths exceeding 3000 feet, and similar wells where a pressure gradient from a drilling fluid is likely to be abnormally high, said drilling being accomplished through a previously installed subsea wellhead which has been secured to a seafloor portion, from an above-surface platform without the use of a conventional riser, said method comprising:

(a) attaching a blowout preventer stack to said subsea wellhead;

(b) securing an upper stack package to said blowout preventer stack, said upper stack package having a portion for seating a rotating head;

(c) rigidly connecting a running collar to a particular portion of a drill string above a drill bit, said running collar having the rotating head severably connected thereto;

(d) running a leading end of said drill string through said wellhead, said blowout preventer stack and said upper stack package into a partially formed borehole;

(e) seating said rotating head in said upper stack package and severing said severable connection between said running collar and said rotating head;

(f) pumping drilling mud through said drill string to said drill bit.

(g) rotating said drill bit in contact with a bottom portion of said borehole so as to further increase its depth.

11. The method of claim 10 further comprising pumping drilling fluid into said borehole as said drill string is withdrawn at a sufficient rate to occupy volume formerly occupied by said drill string and minimize the quantity of seawater than enters said borehole after said rotating head is removed.

12. The method of claim 10 wherein said drill string is rotated during said seating step to insure the engagement of a plurality of dogs on one of said rotating head and said upper stack package in a like plurality of apertures in the other of said rotating head and said upper stack package.

13. The method of claim 10 further comprising connecting a subsea pump to the upper stack package to effectively take drilling mud returns substantially at a level of said seafloor portion and pump them to the above-surface platform thereby reducing said abnormally high pressure gradient.

14. The method of claim 13 further comprising interconnecting a powerfluid conduit between said subsea pump and said above-surface platform.

15. The method of claim 14 further comprising pumping seawater from the ocean surrounding said above-surface platform up onto the platform and then pumping said seawater down the powerfluid conduit to drive said subsea pump.

16. The method of claim 13 further comprising performing a series of successive drilling and casing hanging steps to complete said subsea well to a total design depth, wherein said series of successive drilling and casing hanging steps using said drilling method has a first total number of steps, and said number is significantly reduced from a second total number of steps required in a conventional drilling sequence utilizing a riser.

* * * * *